United States Patent [19]

Fleischer et al.

[11] Patent Number: 4,567,817

[45] Date of Patent: Feb. 4, 1986

[54] EXHAUST-GAS OFFTAKE FOR A TRACK-GUIDED VEHICLE PROPELLED BY COMBUSTION-ENERGY

[75] Inventors: Horst Fleischer, Weinstadt; Herbert Mehren, Stuttgart; Helmut Wulf, Ostfilderstadt, all of Fed. Rep. of Germany

[73] Assignee: Daimler-Benz Aktiengesellschaft, Fed. Rep. of Germany

[21] Appl. No.: 436,936

[22] Filed: Oct. 27, 1982

[30] Foreign Application Priority Data

Oct. 31, 1981 [DE] Fed. Rep. of Germany ..... 3143235

[51] Int. Cl.[4] ..... E21F 1/08; F23J 11/04

[52] U.S. Cl. ..... 98/49; 98/115.4; 104/52; 104/138 R; 104/146; 180/89.2; 180/309

[58] Field of Search ..... 104/51, 52, 138 R, 146; 180/89.2, 309; 98/115.4, 49; 105/62 B, 62 R, 365

[56] References Cited

U.S. PATENT DOCUMENTS

| | | | |
|---|---|---|---|
| 1,904,357 | 4/1933 | Coppus | 104/52 |
| 2,733,668 | 2/1956 | Pfetzing | 104/52 |
| 3,827,523 | 8/1974 | Williams | 180/309 |
| 3,913,470 | 10/1975 | Cullen | 98/115.4 |
| 4,086,847 | 5/1978 | Overmyer | 104/52 X |
| 4,233,889 | 11/1980 | Nederman | 104/52 X |

FOREIGN PATENT DOCUMENTS 870112 3/1960 United Kingdom .

*Primary Examiner*—Robert B. Reeves
*Assistant Examiner*—Glenn B. Foster
*Attorney, Agent, or Firm*—Craig & Burns

[57] ABSTRACT

An exhaust-gas offtake for a track-guided vehicle propelled by combustion-energy, the exhaust gas being led into a force-ventilated waste gas duct located above the vehicle, which is anchored to the roof of a tunnel along the route followed. The exhaust pipe of the vehicle extends vertically through the vehicle interior, up to a point above the roof, and is surrounded by a protective tube. A collecting funnel is located on the vehicle roof, which funnel overlaps the end of the exhaust pipe, possesses a transfer pipe with a boat-shaped cross-section and, pivotably mounted on suspension elements, is resiliently directed into an upwards-pointed position. This arrangement enables small horizontal and vertical movements of the vehicle body to be compensated in relation to the tunnel waste gas duct.

17 Claims, 6 Drawing Figures

Figure 1:
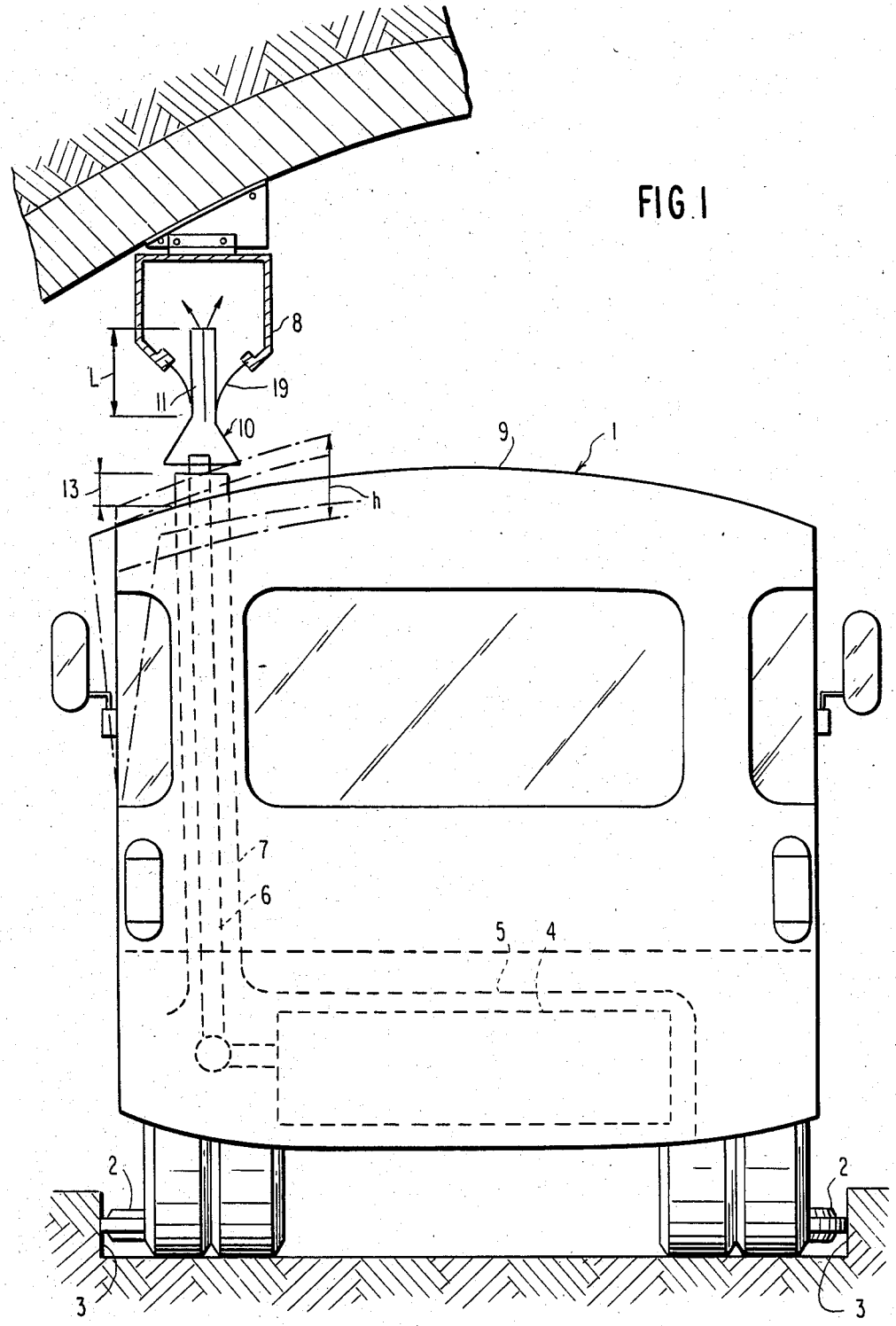

8
L
11
19
10
9
1
13
h
7
6
5
4
2
2
3
3

10
11
12
15
16
17
18
6
7
L 10
11
16
17
18

20°
20°
6
7
9
11
13
14
16
17
18

EXHAUST-GAS OFFTAKE FOR A TRACK-GUIDED VEHICLE PROPELLED BY COMBUSTION-ENERGY

The invention relates to the exhaust-gas offtake for a track-guided vehicle propelled by combustion-energy, the offtake extending vertically above the roof, up into the region of a force-ventilated waste gas duct which is installed along the route followed by the vehicle, and including a fixed portion of an exhaust pipe and its terminal portion possessing lateral mobility about a horizontal pivot axis located parallel to the axis of the vehicle, of the type which is known from, for example, German Offenlegungsschrift No. 2,726,651.

When vehicles propelled by combustion-energy are driven through tunnels, the exhaust gas which they generate must be continuously removed from the tunnel. One possible air-extraction technique, which is both applicable to tunnels and is advantageous with regard to its cost, takes the form of the so-called "snorkel" extraction system, as described in the above-mentioned literature reference. In the case of the vehicle shown in that publication, the exhaust pipe runs vertically up the outside of the rear body-surface, and is laterally pivotable about a pivot-joint which is located at approximately the height of the roll-center of the vehicle, in order to enable its end to follow the waste gas duct in a precise manner, despite certain lateral and rolling movements of the vehicle. This design possesses the disadvantage that the exhaust pipe runs, in an unsightly manner, on the exterior of the vehicle, thereby disfiguring it. Moreover, the long upwards-projecting exhaust pipe necessitates a strong and expensive pivot-joint, and extensive modifications and the installation of extra fittings, compared to conventional vehicle configurations, would have to be performed on the vehicle. Furthermore, a strong guide-slot must be provided, in which the exhaust pipe is laterally guided by means of rollers, in order to guide the comparatively long and heavy pivotable portion of the exhaust pipe inside the waste gas duct. In their turn, these rollers must be guided so that they can move vertically on the exhaust pipe, in order to be able to compensate for movements involving compression of the vehicle suspension. In its entirety, the known exhaust-gas offtake for the "snorkel" extraction system is therefore very heavy and complicated.

The present invention is directed to an exhaust-gas offtake for snorkel-type extraction systems, which does not disfigure the vehicle and is of simple and lightweight constructions.

This is achieved, by combination of the following features:

(a) a portion of the exhaust pipe extends up to the roof is a fixed pipe, running through the vehicle interior and through the roof of the vehicle;

(b) a protective tube is positioned concentrically around, and with a clearance from, that portion of the exhaust pipe which runs through the vehicle interior, this protective tube passing through the roof in a leakproof manner and, at the end in proximity to the engine, opening into the engine compartment;

(c) the exhaust pipe and the protective tube terminate at points which are separated by a small axial interval, a short distance above the roof;

(d) a collecting funnel is located, as the laterally mobile portion of the exhaust-gas offtake, in a hat-like manner and with its axis pointing vertically upwards, above the upper end of the exhaust pipe and of the protective tube, this collecting funnel merging into a transfer pipe having a boat-shaped horizontal cross-section, the longitudinal axis of the boat running parallel to the longitudinal axis of the vehicle.

The invention takes advantage of known exhaust-gas offtakes for omnibuses, see for example British Patent Specification No. 870,112, and further develops these offtakes, in a non-obvious manner, for the purpose of a simple extraction system of the "snorkel" type. The laterally mobile collecting funnel which, with the boat-shaped transfer pipe, is located on the roof, does not disfigure the appearance of the vehicle, expecially when it is located at the rear, on the driver's side and offset from the center line of the vehicle, this side being scarcely visible to the passengers in any case. The pivotable portion of the exhaust-gas offtake, which portion is located on the roof, is of lightweight and simple construction, and can be retrofitted without major problems, and can also be removed again if the vehicle is employed for another purpose.

Accordingly, an object of the invention is an improved exhaust-gas offtake from a motor vehicle.

Another object of the invention is an exhaust-gas offtake for vehicles driven through in closed spaces, such as tunnels.

Another object of the invention is an exhaust-gas offtake of economical construction.

Another object of the invention is an exhaust-gas offtake of lightweight construction.

A still further object of the invention is an exhaust-gas offtake which does not disfigure the appearance of the vehicle.

Another object of the invention is an exhaust-gas offtake which protects the vehicle passengers from the thermal and chemical effects of the exhaust-gas.

Another object of the invention is an exhaust-gas offtake which transmits the exhaust-gas above the vehicle but which does not obstruct the driver's vision.

Another object of the invention is an exhaust-gas offtake which avoids overhead electrical wires.

Another object of the invention is an exhaust-gas offtake which admits of relative motion, both lateral movement and rolling movement of vehicles with respect to tunnel walls.

Another object of the invention is an exhaust-gas offtake which minimizes exhaust blow off in tunnels.

A further object of the invention is an exhaust-gas offtake for a track-guided vehicle propelled by combustion-energy, this offtake extending vertically above the roof, up into the region of a force-ventilated waste gas duct which is installed along the route followed by the vehicle, and including a fixed portion of an exhaust pipe and its terminal portion possessing lateral mobility about a horizontal pivot axis located parallel to the axis of the vehicle, characterized by the combination of the following features:

(a) that portion of the exhaust pipe which extends up to the roof is likewise designed as a fixed pipe, running through the vehicle interior and through the roof of the vehicle;

(b) a protective tube is positioned concentrically around, and with a clearance from, that portion of the exhaust pipe which runs through the vehicle interior, this protective tube passing through the roof in a leakproof manner and, at the end in proximity to the engine, opening into the engine compartment;

(c) the exhaust pipe and the protective tube terminate at points which are separated by a small axial interval, a short distance above the roof;

(d) a collecting funnel is located, as the laterally mobile portion of the exhaust-gas offtake, in a hat-like manner and with its axis pointing vertically upwards, above the upper end of the exhaust pipe and of the protective tube, this collecting funnel merging into a transfer pipe having a boat-shaped horizontal cross-section, the longitudinal axis of the boat running parallel to the longitudinal axis of the vehicle.

Figure 3:
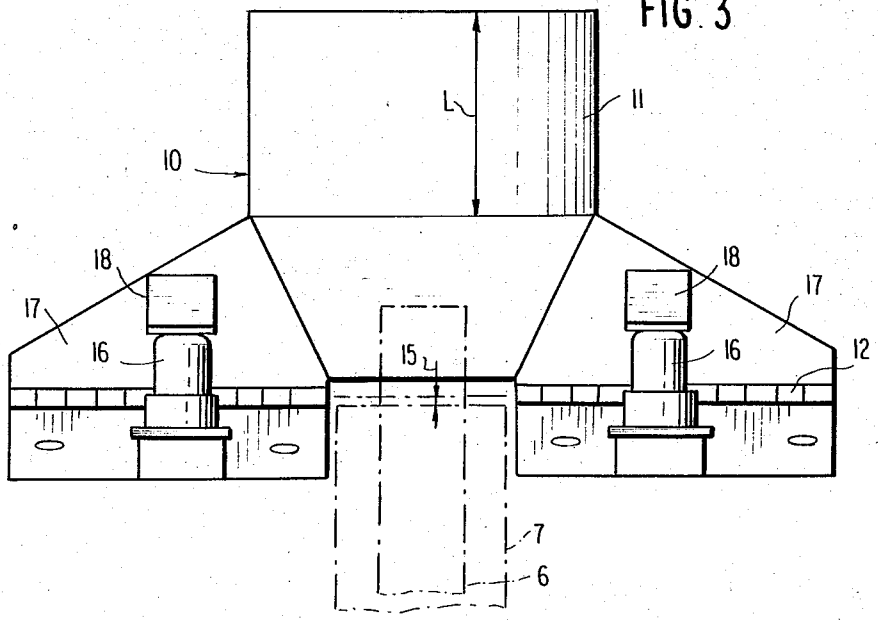
Figure 4:
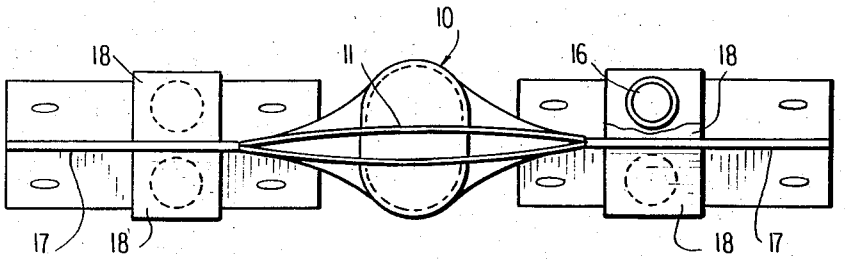
Figure 2:
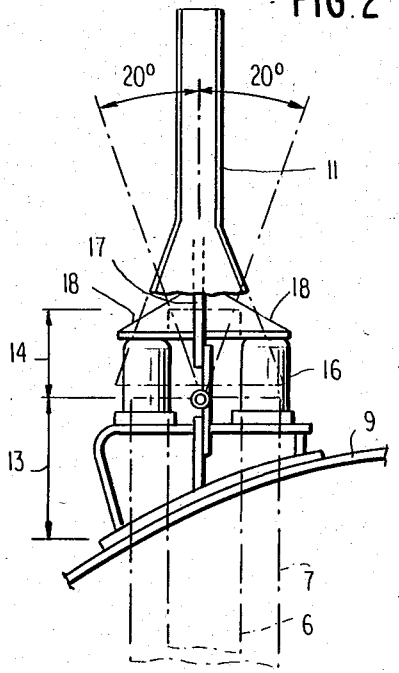
Figure 5:
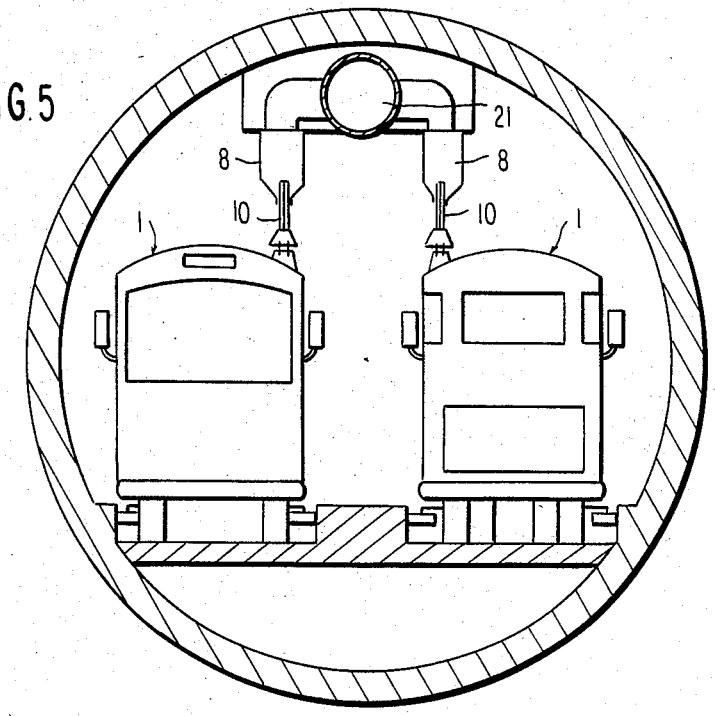
Figure 6:
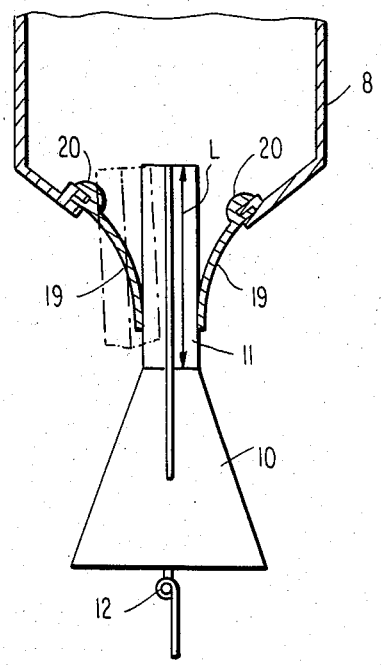

These and other objects, features and advantages of the present invention will become more apparent from the following description when taken in connection with the accompanying drawings which show, for the purpose of illustration only, one embodiment in accordance with the present invention, and wherein:

FIG. 1 shows a vehicle with an exhaust-gas offtake according to the invention, viewed from the rear, FIGS. 2 to 4 respectively show the rear, side and plan views of the pivotable portion of the exhaust-gas offtake according to FIG. 1, which portion is located on the roof of the vehicle, FIG. 5 shows a cross-section through a tunnel, with traffic in both directions, it being possible to ventilate this tunnel by means of the "snorkel" system and waste gas ducts, and FIG. 6 shows details of the waste gas duct.

The vehicle 1, shown in FIG. 1, can be mechanically track-guided on a roadway possessing lateral-guidance risers 3, by means of lateral-guidance rollers 2, these rollers interacting with the lateral-guidance risers. The vehicle is propelled by means of an internal combustion engine 4, which is enclosed in an engine compartment 5, from which its exhaust pipe 6 is led, inside the vehicle, up to a point above the roof 9. In order to protect the vehicle interior, and the passengers, a protective tube 7 is positioned around the exhaust pipe, and with a clearance therefrom, this protective tube 7 passing through the roof 9 in a leakproof manner and, at the end in proximity to the engine 4, opening into the engine compartment 5. As a result of a chimney-effect, or injector-effect, air from the engine compartment 5 is conveyed upwards through the annular gap between the exhaust pipe 6 and the protective tube 7, so that the latter does not become unpleasantly hot. The exhaust pipe 6 and the protective tube 7 terminate at points which are separated by a small axial interval, a short distance above the roof 9, so that sufficient room still remains, in the vertical direction, for adding on the pivotable portion of the exhaust-gas offtake. The exhaust pipe 6 and the protective tube 7 are located in the region of the rear of the vehicle, and are offset from its center line, as a result of which, on the one hand, the driver's rearward vision is impaired as little as possible. In addition, the offset arrangement is expedient when there are also route-sections in which overhead electric wires are installed above the vehicle, these route-sections thus being used both by vehicles propelled by combustion-energy and by electrically propelled vehicles. In such cases, the waste gas duct 8 which, force-ventilated, receives the exhaust-gases from the vehicle, is installed beside the overhead line, and therefore offset relative to the vehicle center line.

On its underside, the waste gas duct 8 is provided with a longitudinal slot, which is closed, in its turn, by means of a pair of resilient sealing line 19. At certain intervals, the waste gas duct 8 is connected to an extraction line 21, FIG. 5, this line leading to a fan. As shown in FIG. 4, the sealing lips 19 can be splayed apart by the collecting funnel 10, and/or by the transfer pipe 11, the latter having a boat-shaped cross-section, the lips 19 bearing against the outside of the transfer pipe 11 and forming a seal as it slides through. Rubbing strips 20, FIG. 6, made of a wear-resistant plastic, are fitted, as contact protectors, inside the waste gas duct 8, in the region of the roots of the sealing lips 19.

A collecting funnel 10 is located above the upper ends of the exhaust pipe 6 and of the protective tube, in a hat-like manner and with its axis pointing vertically upwards, this collecting funnel merging into the transfer pipe 11, which has a boat-shaped horizontal cross-section, with the longitudinal axis of the boat lying parallel to the longitudinal axis of the vehicle. While the vehicle is traversing those sections of the route-network which are equipped with the waste gas extraction system, the transfer pipe 11 projects through the sealing lips 19 and into the waste gas duct 8, FIG. 5. The collecting funnel 10 is capable of pivoting about a pivot axis 12, FIG. 6, which is located horizontally and parallel to the longitudinal axis of the vehicle, as a result of which it is therefore possible to compensate for lateral displacements of the exhaust pipe 6 in relation to the waste gas duct 8. The collecting funnel 10 and, in particular, its transfer pipe 11 are made from stainless steel sheet, so that their surfaces are always smooth and of a bright metallic nature. As a result, the collecting funnel 10 always presents a pleasing appearance and exerts only a very slight wearing action on the sealing lips 19.

Under normal conditions, the collecting funnel 10 is resilient directed into the vertical attitude by means of erecting springs. For this purpose, rubber buffers 16, FIG. 2, are located on both sides of the collecting funnel 10, these buffers 16 serving as erecting springs. Moreover, a first attachment-web 17 is arranged in front of the collecting funnel 10, in the direction in which the vehicle moves, and a second attachment-web 17 is arranged behind the funnel 10, the two webs being located in line with each other. Brackets 18 are fixed laterally to the attachment-web 17 on both sides. The rubber buffers 16 are arranged in a fixed manner beside the attachment-web 17, in each case beneath one of the brackets, these rubber buffers 16 interacting, as stops, with the brackets 18.

A hinge is fastened along the lower, horizontally extending edge of each of the two attachment-webs, this hinge forming the pivot axis 12 and being connected, by its lower portion, to the means for retaining the rubber buffers 16 and to an attachment-plate which conforms to the roof-contour in the region at which the exhaust pipe 6 emerges, and by means of which plate the entire pivotable portion of the exhaust-gas offtake can be fastened to the roof.

By virtue of the vertically directed erection position of the collecting funnel 10, the latter can, at the beginning of a waste gas duct 8, automatically move into the duct, and into its sealing lips 19, via an appropriate run-in device. As a result of the boat-shaped cross-section of the transfer pipe 11, this pipe sides easily through the sealing lips 19, even at comparatively high speeds, the sealing lips 19 being closed both in front of and behind the transfer pipe 11. The pivotable mounting of the collecting funnel 10 enables lateral displacement and rolling movements, as indicated by dash-dotted lines in FIG. 1, to be compensated. The boat-shaped transfer pipe 11 is comparatively long (dimension L) and is designed to be prismatic in shape over this entire length, that is to say, it possesses at least approximately the same cross-sectional shape at all levels. The length L is chosen so that it corresponds to at least the maximum vertical travel h of the vehicle body during movements involving the compression of the vehicles suspension, or during movements of a like nature. By this means, it is also possible to compensate for vertical movements of the collecting funnel 10 relative to the waste gas duct 8.

The transition from the end of the exhuast pipe 6 and from the end of the protective tube 7, into the collecting funnel 10, is designed in such a manner that the exhaust exerts a certain injector effect on the annular cross-section between the exhaust pipe 6 and the protective tube 7. This effect not only causes the engine compartment to be ventilated, but also brings about the cooling of the protective tube 7 and a dilution of the waste gases in the waste gas duct 8. Various measures and/or features are provided in order to enable such air injected effect to be obtained, while, on the other hand, impairing neither the pivoting mobility of the collecting funnel 10, nor the trouble-free transfer of the exhaust gas into the waste gas duct 8. The exhaust pipe 6 projects above the protective tube 7 by approximately 60 to 150% of the exhaust pipe diameter by a dimension 14, FIG. 2. As a result, the exhaust pipe 6 can terminate in the interior of the collecting funnel 10, so that the danger of blowing-off exhaust gases inside the tunnel is, to a substantial extent, avoided, while in addition the collecting funnel 10 needs to be designed only with respect to the size of the exhaust pipe 6, and not with respect to the size of the protective tube 7, the former being smaller. In order to enable the collecting funnel 10 to execute even pronounced pivoting movements, without any danger of colliding with the roof 9, the protective tube 7 projects above the roof 9, at the point where it passes through, by approximately half its diameter. In order to make it possible to guarantee reliable transfer of the exhaust gas, into the collecting funnel 10 and into the waste gas duct 8, even in the pivoted position, the pivot axis is located beneath its lower rim, approximately in the region of the upper edge of the protective tube 7 by a clearance-dimension 15.

While we have shown and described only one embodiment in accordance with the present invention, it is understood that the same is not limited thereto but is susceptible to numerous changes and modifications as known to one having ordinary skill in the art, and we therefore do not wish to be limited to the details shown and described herein, but intend to cover all such modifications as are encompassed by the scope of the appended claims.

We claim:

1. For use with a waste gas duct located along a vehicle route, exhaust-gas offtake for a track-guided vehicle propelled by combustion-energy, comprising:

a fixed portion of exhaust pipe, a terminal portion of exhaust pipe being physically separated from the fixed portion while being in fluid contact therewith and possessing lateral mobility about a horizontal pivot axis located parallel to the axis of travel of the vehicle, the fixed portion of the exhaust pipe runs from an engine through the vehicle interior and through the roof of the vehicle;

a protective tube positioned concentrically around with a clearance from the fixed portion of the exhaust pipe and an end in proximity to the engine opening into an engine compartment and further comprising an end means passing through the roof in leakproof manner terminating a short axial distance below a termination of the fixed portion of the exhaust pipe; and the terminal portion of exhaust pipe comprising a laterally mobile collecting and injector funnel disposed with its longitudinal axis extending above the upper end of the fixed portion of the exhaust pipe and of the protective tube, the collecting funnel merging into a transfer pipe having a boat-shaped horizontal cross-section to assist in insertion of the terminal portion into the waste duct during cruising speeds of the vehicle, the longitudinal axis of the boat-shape running parallel to the longitudinal axis of travel of the vehicle.

2. Exhaust-gas offtake according to claim 1, wherein the protective tube projects above the roof, at the point where it passes through, by approximately half its diameter.

3. Exhaust-gas offtake according to one of claims 1 or 2, wherein the exhaust pipe projects above the protective tube by approximately 60 to 150% of the exhaust pipe diameter.

4. Exhaust-gas offtake according to claim 1, wherein the exhaust pipe terminates in the interior of the collecting funnel.

5. Exhaust-gas offtake according to claim 1, wherein the pivot axis of the collecting funnel lies approximately in the region of the upper edge of the protective tube.

6. Exhaust-gas offtake according to claim 1, further comprising erecting spring means for directing the pivotable collecting funnel into a vertical attitude.

7. Exhaust-gas offtake according to claim 6, wherein the erecting spring means are designed as rubber buffers.

8. Exhaust-gas offtake according to claim 1, further comprising a first attachment-web arranged in front of the collecting funnel, in the direction of vehicle travel, and a second attachment-web arranged behind the funnel, the two webs being located in line with each other and the pivot axis being located at their lower edge.

9. Exhaust-gas offtake according to claim 8, further comprising brackets fixed to at least one of the attachment-webs, on both sides, as stops for the erecting springs which are arranged, vertically and in a fixed manner, beside the attachment-web, on both siees thereof.

10. Exhaust-gas offtake according to claim 1, wherein the boat-shaped transfer pipe of the collecting funnel is designed to be at least approximately prismatic in shape and to have a length (L) corresponding at least to that maximum vertical travel (h) of the vehicle body during movements involving compression of the vehicle suspension and movements of a like nature.

11. Exhaust-gas offtake according to claim 1, wherein the collecting funnel is made of stainless steel sheet.

12. Exhaust-gas offtake according to claim 1, wherein the fixed portion of exhaust pipe and the collecting funnel are located at the rear of the vehicle and are offset from its center line.

13. An exhaust-gas takeoff for a vehicle having an engine located in an engine compartment comprising:

first means interior to the vehicle for conducting exhaust gas from the engine to the exterior of the vehicle, second means surrounding the first means and spaced therefrom for communicating the engine compartment with the exterior of the vehicle to thermally and chemically isolate a vehicle passenger space from exhaust gas, and third means being physically spaced from said first and second means and acting as a fluid injector and pivotable about an axis parallel to the vehicle direction of travel for receiving exhaust gas from said first means, said third means also being in fluid communication with said second means and pivot means in non-contact with the exhaust for allowing said third means to pivot in the transverse direction.

14. An exhaust-gas takeoff in accordance with claim 13, further comprising fourth means for directing return of said third means to a normal position.

15. An exhaust-gas takeoff in accordance with claim 13, further comprising fifth means for conducting exhaust gas received from the third means to a waste gas duct fixed along a vehicle route.

16. An exhaust-gas takeoff in accordance with claim 15, wherein the fifth means comprises means configured as a boat cross-section shape, the longest axis thereof being parallel to the direction of vehicle, the sides of which engage means located on the waste gas duct for sealing the flow of exhaust gas to the waste gas duct against loss to the atmosphere.

17. For use with a waste gas duct located along a vehicle route, exhaust-gas offtake for a guided vehicle propelled by combustion-energy, comprising:

a fixed portion of exhaust pipe, a terminal portion of exhaust pipe possessing lateral mobility about a horizontal pivot axis located parallel to the axis of travel of the vehicle, the fixed portion of the exhaust pipe runs from an engine through the vehicle interior and through the roof of the vehicle;

a protective tube positioned concentrically around, and with a clearance from the fixed portion of the exhaust pipe, the protective tube passing through the roof in a leakproof manner and, at the end in proximity to the engine, opening into an engine compartment;

the terminal portion of exhaust pipe being physically separated from both the fixed portion of the exhaust and the protective tube and comprising a laterally mobile collecting and injector funnel disposed with its longitudinal axis extending above the upper end of the fixed portion of the exhaust pipe and of the protective tube and accepting within its interior a termination of the fixed portion of the exhaust pipe, the collecting funnel merging into a transfer pipe having a boat-shaped horizontal cross-section to assist in insertion of the terminal portion into the waste duct during cruising speeds of the vehicle, the longitudinal axis of the boat-shape running parallel to the longitudinal axis of the travel of the vehicle;

a pivot axis of the collecting funnel lying approximately in the region of the upper end of the protective tube, and erecting spring means for directing the pivotable collecting funnel into a vertical attitude.

* * * * *